US006203584B1

(12) United States Patent
Fuentes-Afflick et al.

(10) Patent No.: US 6,203,584 B1
(45) **Date of Patent: *Mar. 20, 2001**

(54) FUEL COMPOSITION CONTAINING AN AMINE COMPOUND AND AN ESTER

(75) Inventors: Peter A. Fuentes-Afflick, San Francisco; Jeffrey A. Gething, Sausalito, both of CA (US)

(73) Assignee: Chevron Chemical Company LLC, San Francisco, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/052,227

(22) Filed: Mar. 31, 1998

(51) Int. Cl.[7] ..... C10L 1/22; C10L 1/18

(52) U.S. Cl. ..... 44/387; 44/389; 44/400; 44/412; 44/418; 44/419; 44/432; 44/433

(58) Field of Search ..... 44/400, 412, 418, 44/419, 432, 433, 387, 389

(56) References Cited

U.S. PATENT DOCUMENTS

| | | | | |
|---|---|---|---|---|
| 3,960,515 | * | 6/1976 | Honnen | 44/58 |
| 4,191,537 | * | 3/1980 | Lewis et al. | 44/387 |
| 4,247,301 | * | 1/1981 | Honnen | 44/63 |
| 4,609,376 | | 9/1986 | Craig et al. | 44/53 |
| 4,617,026 | | 10/1986 | Shaub et al. | 44/70 |
| 5,004,478 | * | 4/1991 | Vogel et al. | 44/398 |
| 5,522,906 | * | 6/1996 | Hashimoto et al. | 44/400 |
| 5,632,785 | | 5/1997 | Culotta | 44/389 |
| 5,951,723 | * | 9/1999 | Eberhard | 44/387 |
| 6,117,197 | * | 9/2000 | Houser | 44/389 |
| 6,136,051 | * | 10/2000 | Forde et al. | 44/432 |

FOREIGN PATENT DOCUMENTS

| | | | |
|---|---|---|---|
| 0 780 460 | 6/1997 | (EP) | C10L/1/14 |
| 94/17160 | 8/1994 | (WO) | C10L/1/18 |
| 96/18706 | 6/1996 | (WO) | C10L/1/14 |
| 96/18708 | 6/1996 | (WO) | C10L/1/18 |
| 96/23855 | 8/1996 | (WO) | C10L/1/14 |

* cited by examiner

*Primary Examiner*—Jerry D. Johnson
(74) *Attorney, Agent, or Firm*—Claude J. Caroli

(57) ABSTRACT

A fuel composition comprising a major amount of hydrocarbons boiling in the gasoline range and a fuel consumption reducing amount of a fuel additive composition comprising:

(a) at least one amine compound selected from the group consisting of:

(1) a fuel-soluble aliphatic hydrocarbyl-substituted amine having at least one basic nitrogen atom where the hydrocarbyl group has a number average molecular weight of about 700 to 3,000, and (2) a poly(oxyalkylene)amine having at least one basic nitrogen atom and a sufficient number of oxyalkylene units to render the poly(oxyalkylene)amine soluble in hydrocarbons boiling in the gasoline range; and (b) an ester of a carboxylic acid and a polyhydric alcohol, wherein the carboxylic acid has from one to about four carboxylic acid groups and from about 8 to about 50 carbon atoms and the polyhydric alcohol has from about 2 to about 50 carbon atoms and from about 2 to about 6 hydroxy groups.

18 Claims, No Drawings

FUEL COMPOSITION CONTAINING AN AMINE COMPOUND AND AN ESTER

BACKGROUND OF THE INVENTION

1. Field of the Invention

This invention relates to a fuel composition containing an aliphatic hydrocarbyl-substituted amine or a poly (oxyalkylene)amine and an ester of a carboxylic aid and a polyhydric alcohol. In a further aspect, this invention relates to the use of the present fuel composition in an internal combustion engine to reduce friction and thereby improve fuel economy.

2. Description of the Related Art

There has been considerable effort in recent years to improve the fuel economy of motor vehicles. One approach to reducing fuel consumption has been the development of lubricants and lubricating oil additives which reduce engine friction and thus reduce energy requirements. However, the improvements in fuel efficiency obtained with lubricating oil friction reducing additives have been modest and are typically difficult to ascertain without statistical testing in a number of internal combustion engines. Accordingly, increasing effort is now being spent in developing fuel additives as friction modifiers to provide greater fuel economy by reducing friction in the combustion chamber of an internal combustion engine.

Since the conditions in an internal combustion chamber are substantially different from, and much more severe than, those in a crankcase, the fact that a particular additive or class of additives has benefited the performance of a lubricating oil in an internal combustion engine does not mean that benefits will be gained by using the same types of compounds as additives in the fuel. Accordingly, there exists a need in the art for additional methods to improve the fuel economy of internal combustion engines used to power automotive vehicles.

U.S. Pat. No. 4,617,026 to Shaub et al. discloses a method of reducing fuel consumption in an automotive internal combustion engine which comprises operating the engine with a gasoline fuel containing an additive which is a hydroxyl-containing ester of a monocarboxylic acid and a glycol or trihydric alcohol, wherein the ester additive has at least one free hydroxyl group.

U.S. Pat. No. 4,609,376 to Craig et al. discloses the use of an additive in alkanol fuels to reduce engine wear and improve lubricity, wherein the additive comprises an ester of a monocarboxylic or polycarboxylic acid and a polyhydric alcohol, and further wherein the ester contains at least two free hydroxyl groups.

U.S. Pat. No. 5,632,785 to Culotta discloses a method for reducing fuel consumption in an internal combustion engine which comprises operating the engine with a fuel composition containing an additive which is an ester of polyhydric polyether having ether oxygens and free and esterified hydroxyl groups in the polyhydric polyether backbone of the ester. This patent further teaches that a specific example of such additives is decaglycerol tetraoleate, which is an ester of decaglycerol and oleic acid containing an average of four adducted oleic acid units and ten to twelve free hydroxyl groups.

In the diesel fuel area, the increased use of diesel fuels having a low sulfur content has led to the development of diesel fuel additives which will improve the anti-wear and lubricity properties of such low-sulfur fuels.

For example, PCT Publication No. WO 96/18706 discloses a diesel fuel composition having a sulfur content of at most 0.2% by weight which contains a minor proportion of a lubricity enhancer, such as the ester of a polyhydric alcohol, in combination with at least one nitrogen compound having one or more substituents of the formula >NR, wherein R is a hydrocarbyl group of 8 to 40 carbon atoms. This publication further discloses that the nitrogen compound may be an amine salt and/or amide formed by reacting at least one molar proportion of a hydrocarbyl-substituted amine and a molar proportion of a hydrocarbyl acid having from 1 to 4 carboxylic acid groups or its anhydride.

PCT Publication No. WO 96/23855 discloses a diesel fuel composition containing not more than 0.05% by weight of sulfur and a minor amount of an additive composition comprising (a) an ashless dispersant comprising an acylated nitrogen compound, and (b) a carboxylic acid or an ester of the carboxylic acid and an alcohol wherein the acid has from 2 to 50 carbon atoms and the alcohol has one or more carbon atoms.

PCT Publication No. WO 96/18708 discloses a diesel fuel composition having a sulfur content of at most 0.2% by weight which contains minor proportions of a lubricity enhancer, such as the ester of a polyhydric alcohol and a carboxylic acid, and at least one ethylene-unsaturated ester copolymer.

PCT Publication No. WO 94/17160 discloses a diesel fuel composition having a sulfur concentration of 0.2% by weight or less and a minor proportion of an additive comprising an ester of a carboxylic acid and an alcohol, wherein the acid has from 2 to 50 carbon atoms and the alcohol has one or more carbon atoms.

In addition, European Patent Application Publication No. EP 0,780,460 A1, published Jun. 25, 1997, discloses a gasoline additive concentrate comprising a lubricity additive selected from the group consisting of saturated and unsaturated fatty acids, oligomerized saturated and unsaturated fatty acids, esters of such fatty acids and oligomerized fatty acids and mixtures thereof, in an aromatic solvent, and containing a compatibilizer which remains liquid at temperatures at least as low as 0° C. selected from the group consisting of an alcohol, an amine, and mixtures thereof. This publication further teaches that the alcohol is a $C_2$ to $C_{10}$ alcohol, preferably a $C_2$ to $C_8$ alcohol, and the amine is a $C_{12}$ to $C_{75}$ amine having at least one nitrogen, preferably a $C_{12}$ to $C_{18}$ amine.

SUMMARY OF THE INVENTION

It has now been discovered that the unique combination of an aliphatic hydrocarbyl-substituted amine or a poly (oxyalkylene)amine and an ester of a carboxylic acid and a polyhydric alcohol provides a significant reduction in friction and in the fuel consumption of an internal combustion engine.

Accordingly, the present invention provides a novel fuel composition comprising a major amount of hydrocarbons boiling in the gasoline range and a fuel consumption reducing amount of a fuel additive composition comprising:

(a) at least one amine compound selected from the group consisting of:
  (1) a fuel-soluble aliphatic hydrocarbyl-substituted amine having at least one basic nitrogen atom where the hydrocarbyl group has a number average molecular weight of about 700 to 3,000, and
  (2) a poly(oxyalkylene)amine having at least one basic nitrogen atom and a sufficient number of oxyalkylene units to render the poly(oxyalkylene)amine soluble in hydrocarbons boiling in the gasoline range; and (b) an ester of a carboxylic acid and a polyhydric alcohol, wherein the carboxylic acid has from one to about four carboxylic acid groups and from about 8 to about 50 carbon atoms and the polyhydric alcohol has from about 2 to about 50 carbon atoms and from about 2 to about 6 hydroxy groups.

The present invention further provides a method for reducing fuel consumption in an internal combustion engine which comprises operating the engine with the novel fuel composition of the present invention.

Among other factors, the present invention is based on the surprising discovery that the unique combination of an aliphatic hydrocarbyl-substituted amine or a poly (oxyalkylene)amine and an ester of a carboxylic acid and a polyhydric alcohol significantly reduces fuel consumption in an internal combustion engine and unexpectedly provides a greater reduction in friction than either component by itself.

DETAILED DESCRIPTION OF THE INVENTION

As noted above, the fuel composition of the present invention contains (a) at least one amine compound which may be an aliphatic hydrocarbyl-substituted amine or a poly(oxyalkylene)amine and (b) an ester of a carboxylic acid and a polyhydric alcohol. These compounds are described in further detail below.

The Amine Compound (1) The Aliphatic Hydrocarbyl-Substituted Amine

The fuel-soluble aliphatic hydrocarbyl-substituted amine employed in the present fuel composition is a straight or branched chain hydrocarbyl-substituted amine having at least one basic nitrogen atom wherein the hydrocarbyl group has a number average molecular weight of about 700 to 3,000. Typically, such aliphatic amines will be of sufficient molecular weight so as to be nonvolatile at normal engine intake valve operating temperatures, which are generally in the range of about 175° C. to 300° C.

Preferably, the hydrocarbyl group will have a number average molecular weight in the range of about 750 to 2,200, more preferably, in the range of about 900 to 1,500, and even more preferably, in the range of about 1,200 to 1,500. The hydrocarbyl group will generally be branched chain.

When employing a branched-chain hydrocarbyl amine, the hydrocarbyl group is preferably derived from polymers of $C_2$ to $C_6$ olefins. Such branched-chain hydrocarbyl groups will ordinarily be prepared by polymerizing olefins of from 2 to 6 carbon atoms (ethylene being copolymerized with another olefin so as to provide a branched-chain). The branched chain hydrocarbyl group will generally have at least 1 branch per 6 carbon atoms along the chain, preferably at least 1 branch per 4 carbon atoms along the chain and, more preferably, at least 1 branch per 2 carbon atoms along the chain. The preferred branched-chain hydrocarbyl groups are derived from polypropylene and polyisobutylene. The branches will usually be of from 1 to 2 carbon atoms, preferably 1 carbon atom, that is, methyl.

In most instances, the branched-chain hydrocarbyl amines are not a pure single product, but rather a mixture of compounds having an average molecular weight. Usually, the range of molecular weights will be relatively narrow and peaked near the indicated molecular weight.

The amine component of the branched-chain hydrocarbyl amines may be derived from ammonia, a monoamine or a polyamine. The monoamine or polyamine component embodies a broad class of amines having from 1 to about 12 amine nitrogen atoms and from 1 to about 40 carbon atoms with a carbon to nitrogen ratio between about 1:1 and 10:1. Generally, the monoamine will contain from 1 to about 40 carbon atoms and the polyamine will contain from 2 to about 12 amine nitrogen atoms and from 2 to about 40 carbon atoms. In most instances, the amine component is not a pure single product, but rather a mixture of compounds having a major quantity of the designated amine. For the more complicated polyamines, the compositions will be a mixture of amines having as the major product the compound indicated and having minor amounts of analogous compounds. Suitable monoamines and polyamines are described more fully below.

When the amine component is a polyamine, it will preferably be a polyalkylene polyamine, including alkylenediamine. Preferably, the alkylene group will contain from 2 to 6 carbon atoms, more preferably from 2 to 3 carbon atoms. Examples of such polyamines include ethylene diamine, diethylene triamine, triethylene tetramine and tetraethylene pentamine. Preferred polyamines are ethylene diamine and diethylene triamine.

Particularly preferred branched-chain hydrocarbyl amines include polyisobutenyl ethylene diamine and polyisobutyl amine, wherein the polyisobutyl group is substantially saturated and the amine moiety is derived from ammonia.

The aliphatic hydrocarbyl amines employed in the fuel composition of the invention are prepared by conventional procedures known in the art. Such aliphatic hydrocarbyl amines and their preparations are described in detail in U.S. Pat. Nos. 3,438,757; 3,565,804; 3,574,576; 3,848,056; 3,960,515; and 4,832,702, the disclosures of which are incorporated herein by reference.

Typically, the hydrocarbyl-substituted amines employed in this invention are prepared by reacting a hydrocarbyl halide, such as a hydrocarbyl chloride, with ammonia or a primary or secondary amine to produce the hydrocarbyl-substituted amine.

As noted above, the amine component of the presently employed hydrocarbyl-substituted amine is derived from a nitrogen-containing compound selected from ammonia, a monoamine having from 1 to about 40 carbon atoms, and a polyamine having from 2 to about 12 amine nitrogen atoms and from 2 to about 40 carbon atoms. The nitrogen-containing compound is reacted with a hydrocarbyl halide to produce the hydrocarbyl-substituted amine fuel additive finding use within the scope of the present invention. The amine component provides a hydrocarbyl amine reaction product with, on average, at least about one basic nitrogen atom per product molecule, i.e., a nitrogen atom titratable by a strong acid.

Preferably, the amine component is derived from a polyamine having from 2 to about 12 amine nitrogen atoms and from 2 to about 40 carbon atoms. The polyamine preferably has a carbon-to-nitrogen ratio of from about 1:1 to 10:1.

The polyamine may be substituted with substituents selected from (a) hydrogen, (b) hydrocarbyl groups of from 1 to about 10 carbon atoms, (c) acyl groups of from 2 to about 10 carbon atoms, and (d) monoketo, monohydroxy, mononitro, monocyano, lower alkyl and lower alkoxy derivatives of (b) and (c). "Lower", as used in terms like lower alkyl or lower alkoxy, means a group containing from 1 to about 6 carbon atoms. At least one of the substituents on one of the basic nitrogen atoms of the polyamine is hydrogen, e.g., at least one of the basic nitrogen atoms of the polyamine is a primary or secondary amino nitrogen.

Hydrocarbyl, as used in describing the polyamine moiety on the aliphatic amine employed in this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such as 2-hydroxyethyl, 3-hydroxypropyl, hydroxy-isopropyl, 4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, diethyleneoxymethyl, triethyleneoxyethyl, tetraethyleneoxyethyl, diethyleneoxyhexyl, etc. The aforementioned acyl groups (c) are such as propionyl, acetyl, etc. The more preferred substituents are hydrogen, $C_1$–$C_6$ alkyls and $C_1$–$C_6$ hydroxyalkyls.

In a substituted polyamine, the substituents are found at any atom capable of receiving them. The substituted atoms, e.g., substituted nitrogen atoms, are generally geometrically unequivalent, and consequently the substituted amines finding use in the present invention can be mixtures of mono- and poly-substituted polyamines with substituent groups situated at equivalent and/or unequivalent atoms.

The more preferred polyamine finding use within the scope of the present invention is a polyalkylene polyamine, including alkylene diamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Such groups are exemplified by ethylene, 1,2-propylene, 2,2-dimethylpropylene, trimethylene, 1,3,2-hydroxypropylene, etc. Examples of such polyamines include ethylene diamine, diethylene triamine, di(trimethylene)triamine, dipropylene triamine, triethylene tetraamine, tripropylene tetraamine, tetraethylene pentamine, and pentaethylene hexamine. Such amines encompass isomers such as branched-chain polyamines and previously-mentioned substituted polyamines, including hydroxy- and hydrocarbyl-substituted polyamines. Among the polyalkylene polyamines, those containing 2–12 amino nitrogen atoms and 2–24 carbon atoms are especially preferred, and the $C_2$–$C_3$ alkylene polyamines are most preferred, that is, ethylene diamine, polyethylene polyamine, propylene diamine and polypropylene polyamine, and in particular, the lower polyalkylene polyamines, e.g., ethylene diamine, dipropylene triamine, etc. Particularly preferred polyalkylene polyamines are ethylene diamine and diethylene triamine.

The amine component of the presently employed aliphatic amine fuel additive also may be derived from heterocyclic polyamines, heterocyclic substituted amines and substituted heterocyclic compounds, wherein the heterocycle comprises one or more 5–6 membered rings containing oxygen and/or nitrogen. Such heterocyclic rings may be saturated or unsaturated and substituted with groups selected from the aforementioned (a), (b), (c) and (d). The heterocyclic compounds are exemplified by piperazines, such as 2-methylpiperazine, N-(2-hydroxyethyl)-piperazine, 1,2-bis-(N-piperazinyl) ethane and N,N'-bis(N-piperazinyl)piperazine, 2-methylimidazoline, 3-aminopiperidine, 3-aminopyridine, N-(3-aminopropyl)-morpholine, etc. Among the heterocyclic compounds, the piperazines are preferred.

Typical polyamines that can be used to form the aliphatic amine additives employed in this invention by reaction with a hydrocarbyl halide include the following: ethylene diamine, 1,2-propylene diamine, 1,3-propylene diamine, diethylene triamine, triethylene tetramine, hexamethylene diamine, tetraethylene pentamine, dimethylaminopropylene diamine, N-(beta-aminoethyl)piperazine, N-(beta-aminoethyl)piperidine, 3-amino-N-ethylpiperidine, N-(beta-aminoethyl)morpholine, N,N'-di(beta-aminoethyl) piperazine, N,N'-di(beta-aminoethyl)imidazolidone-2, N-(beta-cyanoethyl)ethane-1,2-diamine, 1-amino-3,6,9-triazaoctadecane, 1-amino-3,6-diaza-9-oxadecane, N-(beta-aminoethyl)diethanolamine, N'-acetylmethyl-N-(beta-aminoethyl) ethane-1,2-diamine, N-acetonyl-1,2-propanediamine, N-(beta-nitroethyl)-1,3-propane diamine, 1,3-dimethyl-5(beta-aminoethyl)hexahydrotriazine, N-(beta-aminoethyl)-hexahydrotriazine, 5-(beta-aminoethyl)-1,3,5-dioxazine, 2-(2-aminoethylamino) ethanol, and 2-[2-(2-aminoethylamino)ethylamino]ethanol.

Alternatively, the amine component of the presently employed aliphatic hydrocarbyl-substituted amine may be derived from an amine having the formula:

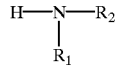

wherein $R_1$ and $R_2$ are independently selected from the group consisting of hydrogen and hydrocarbyl of 1 to about 20 carbon atoms and, when taken together, $R_1$ and $R_2$ may form one or more 5- or 6-membered rings containing up to about 20 carbon atoms. Preferably, $R_1$ is hydrogen and $R_2$ is a hydrocarbyl group having 1 to about 10 carbon atoms. More preferably, $R_1$ and $R_2$ are hydrogen. The hydrocarbyl groups may be straight-chain or branched and may be aliphatic, alicyclic, aromatic or combinations thereof. The hydrocarbyl groups may also contain one or more oxygen atoms.

An amine of the above formula is defined as a "secondary amine" when both $R_1$ and $R_2$ are hydrocarbyl. When $R_1$ is hydrogen and $R_2$ is hydrocarbyl, the amine is defined as a "primary amine"; and when both $R_1$ and $R_2$ are hydrogen, the amine is ammonia.

Primary amines useful in preparing the aliphatic hydrocarbyl-substituted amine fuel additives of the present invention contain 1 nitrogen atom and 1 to about 20 carbon atoms, preferably 1 to 10 carbon atoms. The primary amine may also contain one or more oxygen atoms.

Preferably, the hydrocarbyl group of the primary amine is methyl, ethyl, propyl, butyl, pentyl, hexyl, octyl, 2-hydroxyethyl or 2-methoxyethyl. More preferably, the hydrocarbyl group is methyl, ethyl or propyl.

Typical primary amines are exemplified by N-methylamine, N-ethylamine, N-n-propylamine, N-isopropylamine, N-n-butylamine, N-isobutylamine, N-sec-butylamine, N-tert-butylamine, N-n-pentylamine, N-cyclopentylamine, N-n-hexylamine, N-cyclohexylamine, N-octylamine, N-decylamine, N-dodecylamine, N-octadecylamine, N-benzylamine, N-(2-phenylethyl) amine, 2-aminoethanol, 3-amino-1-proponal, 2-(2-aminoethoxy)ethanol, N-(2-methoxyethyl)amine, N-(2-ethoxyethyl)amine, and the like. Preferred primary amines are N-methylamine, N-ethylamine and N-n-propylamine.

The amine component of the presently employed aliphatic hydrocarbyl-substituted amine fuel additive may also be derived from a secondary amine. The hydrocarbyl groups of the secondary amine may be the same or different and will generally contain 1 to about 20 carbon atoms, preferably 1 to about 10 carbon atoms. One or both of the hydrocarbyl groups may also contain one or more oxygen atoms.

Preferably, the hydrocarbyl groups of the secondary amine are independently selected from the group consisting of methyl, ethyl, propyl, butyl, pentyl, hexyl, 2-hydroxyethyl and 2-methoxyethyl. More preferably, the hydrocarbyl groups are methyl, ethyl or propyl.

Typical secondary amines which may be used in this invention include N,N-dimethylamine, N,N-diethylamine, N,N-di-n-propylamine, N,N-diisopropylamine, N,N-di-n-butylamine, N,N-di-sec-butylamine, N,N-di-n-pentylamine, N,N-di-n-hexylamine, N,N-dicyclohexylamine, N,N-dioctylamine, N-ethyl-N-methylamine, N-methyl-N-n-propylamine, N-n-butyl-N-methylamine, N-methyl-N-octylamine, N-ethyl-N-isopropylamine, N-ethyl-N-octylamine, N,N-di(2-hydroxyethyl)amine, N, N-di(3-hydroxypropyl)amine, N,N-di(ethoxyethyl)amine, N,N-di (propoxyethyl)amine, and the like. Preferred secondary amines are N,N-dimethylamine, N,N-diethylamine and N,N-di-n-propylamine.

Cyclic secondary amines may also be employed to form the aliphatic amine additives of this invention. In such cyclic compounds, $R_1$ and $R_2$ of the formula hereinabove, when taken together, form one or more 5- or 6-membered rings containing up to about 20 carbon atoms. The ring containing the amine nitrogen atom is generally saturated, but may be fused to one or more saturated or unsaturated rings. The rings may be substituted with hydrocarbyl groups of from 1 to about 10 carbon atoms and may contain one or more oxygen atoms.

Suitable cyclic secondary amines include piperidine, 4-methylpiperidine, pyrrolidine, morpholine, 2,6-dimethylmorpholine, and the like.

In many instances, the amine component is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetraamine, substituted piperazines and pentaethylene hexamine, but the composition will be mainly tetraethylene pentamine and the empirical formula of the total amine composition will closely approximate that of tetraethylene pentamine. Finally, in preparing the compounds employed in this invention using a polyamine, where the various nitrogen atoms of the polyamine are not geometrically equivalent, several substitutional isomers are possible and are encompassed within the final product. Methods of preparation of amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99–116.

Preferred aliphatic hydrocarbyl-substituted amines suitable for use in the present invention are hydrocarbyl-substituted polyalkylene polyamines having the formula:

$$R_3NH—(R_4—NH)_n—H$$

wherein $R_3$ is a hydrocarbyl group having a number average molecular weight of about 700 to 3,000; $R_4$ is alkylene of from 2 to 6 carbon atoms; and n is an integer of from 0 to about 10.

Preferably, $R_3$ is a hydrocarbyl group having a number average molecular weight of about 750 to 2,200, more preferably, from about 900 to 1,500, and even more preferably, from about 1,200 to 1,500. Preferably, $R_4$ is alkylene of from 2 to 3 carbon atoms and n is preferably an integer of from 1 to 6.

(2) The Poly(oxyalkylene)Amine

The poly(oxyalkylene)amine employed in the present fuel composition is a poly(oxyalkylene)amine having at least one basic nitrogen atom and a sufficient number of oxyalkylene units to render the poly(oxyalkylene)amine soluble in hydrocarbons boiling in the gasoline range.

Preferably, such poly(oxyalkylene)amines will also be of sufficient molecular weight so as to be nonvolatile at normal engine intake valve operating temperatures, which are generally in the range of about 200° C. to 250° C.

Generally, the poly(oxyalkylene)amines suitable for use in the present invention will contain at least about 5 oxyalkylene units, preferably about 5 to 100, more preferably about 8 to 100, and even more preferably about 10 to 100. Especially preferred poly(oxyalkylene)amines will contain about 10 to 25 oxyalkylene units.

The molecular weight of the presently employed poly (oxyalkylene)amines will generally range from about 500 to about 10,000, preferably from about 500 to about 5,000.

Suitable poly(oxyalkylene)amine compounds for use in the present invention include hydrocarbyl poly(oxyalkylene) polyamines as disclosed, for example, in U.S. Pat. No. 4,247,301, issued Jan. 27, 1981 to Honnen, the disclosure of which is incorporated herein by reference. These compounds are hydrocarbyl poly(oxyalkylene)polyamines wherein the poly(oxyalkylene) moiety comprises at least one hydrocarbyl-terminated poly(oxyalkylene) chain of 2 to 5 carbon atom oxyalkylene units, and wherein the poly (oxyalkylene) chain is bonded through a terminal carbon atom to a nitrogen atom of a polyamine having from 2 to about 12 amine nitrogen atoms and from 2 to about 40 carbon atoms with a carbon-to-nitrogen ratio between about 1:1 and 10:1. The hydrocarbyl group on these hydrocarbyl poly(oxyalkylene)polyamines will contain from about 1 to 30 carbon atoms. These compounds generally have molecular weights in the range of about 500 to 10,000, preferably from about 500 to 5,000 and more preferably from about 800 to 5,000.

The above-described hydrocarbyl poly(oxyalkylene) polyamines are prepared by conventional procedures known in the art, as taught, for example, in U.S. Pat. No. 4,247,301.

Other poly(oxyalkylene)amines suitable for use in the present invention are the poly(oxyalkylene)polyamines wherein the poly(oxyalkylene) moiety is connected to the polyamine moiety through an oxyalkylene hydroxy-type linkage derived from an epihalohydrin, such as epichlorohydrin or epibromohydrin. This type of poly(oxyalkylene) amine having an epihalohydrin-derived linkage is described, for example, in U.S. Pat. No. 4,261,704, issued Apr. 14, 1981 to Langdon, the disclosure of which is incorporated herein by reference.

Useful polyamines for preparing the epihalohydrin-derived poly(oxyalkylene)polyamines include, for example, alkylene polyamines, polyalkylene polyamines, cyclic amines, such as piperazines, and amino-substituted amines. The poly(oxyalkylene)polyamines having an epihalohydrin-derived linkage between the poly(oxyalkylene) and polyamine moieties are prepared using known procedures as taught, for example, in U.S. Pat. No. 4,261,704.

Another type of poly(oxyalkylene)amine useful in the present invention is a highly branched alkyl poly (oxyalkylene)monoamine as described, for example in U.S. Pat. No. 5,094,667, issued Mar. 10, 1992 to Schilowitz et al., the disclosure of which is incorporated herein by reference. These highly branched alkyl poly(oxyalkylene)monoamines have the general formula:

$$R_7—O—(C_4H_8O)_pCH_2CH_2CH_2NH_2$$

wherein $R_7$ is a highly branched alkyl group containing from 12 to 40 carbon atoms, preferably an alkyl group having 20 carbon atoms which is derived from a Guerbet condensation reaction, and p is a number up to 30, preferably 4 to 8. The preferred alkyl group is derived from a Guerbet alcohol containing 20 carbon atoms having the formula:

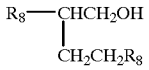

wherein $R_8$ is a hydrocarbyl chain.

The above highly branched alkyl poly(oxyalkylene) monoamines are prepared by using known methods as disclosed, for example, in U.S. Pat. No. 5,094,667.

A preferred class of poly(oxyalkylene)amine for use in the fuel composition of the present invention are hydrocarbyl poly(oxyalkylene)monoamines as described, for example, in U.S. Pat. No. 5,112,364, issued May 12, 1992 to Rath et al., the disclosure of which is incorporated herein by reference. As disclosed in U.S. Pat. No. 5,112,364, such poly (oxyalkylene)monoamines may be prepared by the reductive amination of a phenol-initiated or alkylphenol-initiated poly (oxyalkylene) alcohol with ammonia or a primary amine.

In addition, the above-mentioned U.S. Pat. No. 4,247,301 to Honnen discloses hydrocarbyl poly(oxyalkylene) monoamines which are suitable for use in the present fuel additive composition. In particular, Example 6 of this patent describes alkylphenyl poly(oxyalkylene)monoamines prepared from ammonia and dimethylamine.

A particularly preferred type of hydrocarbyl poly (oxyalkylene)monoamine is an alkylphenyl poly (oxyalkylene)monoamine wherein the poly(oxyalkylene) moiety contains oxypropylene units or oxybutylene units or mixtures of oxypropylene and oxybutylene units. Preferably, the alkyl group on the alkylphenyl moiety is a straight or branched-chain alkyl of 1 to 24 carbon atoms. An especially preferred alkylphenyl moiety is tetrapropenylphenyl, that is, where the alkyl group is a branched-chain alkyl of 12 carbon atoms derived from propylene tetramer.

A further discussion of the hydrocarbon-substituted poly (oxyalkylene) moiety on the poly(oxyalkylene)amine component of the present fuel composition is found hereinbelow.

Another preferred class of poly(oxyalkylene)amine for use in the fuel additive composition of the present invention are hydrocarbyl-substituted poly(oxyalkylene) aminocarbamates disclosed, for example, in U.S. Pat. Nos. 4,288,612; 4,236,020; 4,160,648; 4,191,537; 4,270,930; 4,233,168; 4,197,409; 4,243,798 and 4,881,945, the disclosure of each of which are incorporated herein by reference.

These hydrocarbyl poly(oxyalkylene)aminocarbamates contain at least one basic nitrogen atom and have an average molecular weight of about 500 to 10,000, preferably about 500 to 5,000, and more preferably about 1,000 to 3,000. As described more fully hereinbelow, these hydrocarbyl poly (oxyalkylene)aminocarbamates contain (a) a poly (oxyalkylene) moiety, (b) an amine moiety, and (c) a carbamate connecting group.

A. The Poly(oxyalkylene) Moiety

The hydrocarbyl-terminated poly(oxyalkylene)polymers which are utilized in preparing the hydrocarbyl poly (oxyalkylene)aminocarbamates employed in the present invention are monohydroxy compounds, e.g., alcohols, often termed monohydroxy polyethers, or polyalkylene glycol monocarbyl ethers, or "capped" poly(oxyalkylene)glycols, and are to be distinguished from the poly(oxyalkylene) glycols (diols), or polyols, which are not hydrocarbyl-terminated, i.e., are not capped. These hydrocarbyl poly (oxyalkylene) alcohols may be produced by the addition of lower alkylene oxides, such as ethylene oxide, propylene oxide, butylene oxide, etc. to a hydroxy compound, $R_9OH$, under polymerization conditions, wherein $R_9$ is the hydrocarbyl group which caps the poly(oxyalkylene) chain.

In the hydrocarbyl poly(oxyalkylene)aminocarbamates employed in the present invention, the hydrocarbyl group $R_9$ will generally contain from 1 to about 30 carbon atoms, preferably from 2 to about 20 carbon atoms and is preferably aliphatic or aromatic, i.e., an alkyl or alkyl phenyl wherein the alkyl is a straight or branched-chain of from 1 to about 24 carbon atoms. More preferably, $R_9$ is alkylphenyl wherein the alkyl group is a branched-chain of 12 carbon atoms, derived from propylene tetramer, and commonly referred to as tetrapropenyl.

The oxyalkylene units in the poly(oxyalkylene) moiety preferably contain from 2 to about 5 carbon atoms but one or more units of a larger carbon number may also be present. Generally, each poly(oxyalkylene)polymer contains at least about 5 oxyalkylene units, preferably about 5 to about 100 oxyalkylene units, more preferably about 8 to about 100 units, even more preferably about 10 to 100 units, and most preferably 10 to about 25 such units. The poly(oxyalkylene) moiety of the hydrocarbyl poly(oxyalkylene) aminocarbamates employed in the present invention is more fully described and exemplified in U.S. Pat. No. 4,191,537, issued Mar. 4, 1980 to Lewis, the disclosure of which is incorporated herein by reference.

Although the hydrocarbyl group on the hydrocarbyl poly (oxyalkylene) moiety will preferably contain from 1 to about 30 carbon atoms, longer hydrocarbyl groups, particularly longer chain alkyl phenyl groups, may also be employed. For example, alkylphenyl poly(oxyalkylene) aminocarbamates wherein the alkyl group contains at least 40 carbon atoms, as described in U.S. Pat. No. 4,881,945, issued Nov. 21, 1989 to Buckley, are also contemplated for use in the present invention. The alkyl phenyl group on the aminocarbamates of U.S. Pat. No. 4,881,945 will preferably contain an alkyl group of 50 to 200 carbon atoms, and more preferably, an alkyl group of 60 to 100 carbon atoms. These longer chain alkyl groups will generally be derived from olefin polymers, such as polybutene. The disclosure of U.S. Pat. No. 4,881,945 is incorporated herein by reference.

Also contemplated for use in the present invention are alkylphenyl poly(oxypropylene)aminocarbamates wherein the alkyl group is a substantially straight-chain alkyl group of about 25 to 50 carbon atoms derived from an alpha olefin oligomer of $C_8$ to $C_{20}$ alpha olefins, as described in PCT International Patent Application Publication No. WO 90/07564, published Jul. 12, 1990, the disclosure of which is incorporated herein by reference.

B. The Amine Moiety

The amine moiety of the hydrocarbyl poly(oxyalkylene) aminocarbamate is preferably derived from a polyamine having from 2 to about 12 amine nitrogen atoms and from 2 to about 40 carbon atoms.

The polyamine is preferably reacted with a hydrocarbyl poly(oxyalkylene)chloroformate to produce the hydrocarbyl poly(oxyalkylene)aminocarbamate fuel additive finding use within the scope of the present invention. The chloroformate is itself derived from the hydrocarbyl poly(oxyalkylene) alcohol by reaction with phosgene.

The polyamine provides the hydrocarbyl poly (oxyalkylene)aminocarbamate with, on the average, at least about one basic nitrogen atom per carbamate molecule, i.e., a nitrogen atom titratable by strong acid. The polyamine preferably has a carbon-to-nitrogen ratio of from about 1:1 to about 10:1. The polyamine may be substituted with substituents selected from hydrogen, hydrocarbyl groups of from 1 to about 10 carbon atoms, acyl groups of from 2 to about 10 carbon atoms, and monoketone, monohydroxy, mononitro, monocyano, alkyl and alkoxy derivatives of hydrocarbyl groups of from 1 to 10 carbon atoms. It is preferred that at least one of the basic nitrogen atoms of the polyamine is a primary or secondary amino nitrogen. The amine moiety of the hydrocarbyl poly(oxyalkylene) aminocarbamates employed in the present invention has been described and exemplified more fully in U.S. Pat. No. 4,191,537.

A more preferred polyamine for use in preparing the hydrocarbyl poly(oxyalkylene)aminocarbamates finding use within the scope of the present invention is a polyalkylene polyamine, including alkylenediamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Examples of such polyamines include ethylenediamine, diethylenetriamine, triethylenetetramine, di(trimethylene) triamine, dipropylenetriamine, tetraethylenepentamine, etc.

Among the polyalkylene polyamines, polyethylene polyamine and polypropylene polyamine containing 2 to about 12 amine nitrogen atoms and 2 to about 24 carbon atoms are especially preferred and in particular, the lower polyalkylene polyamines, e.g., ethylenediamine, diethylenetriamine, propylenediamine, dipropylenetriamine, etc., are most preferred.

C. The Aminocarbamate Connecting Group

The hydrocarbyl poly(oxyalkylene)aminocarbamate employed as the poly(oxyalkylene)amine component of the fuel composition of the present invention is obtained by linking the polyamine and the hydrocarbyl poly (oxyalkylene) alcohol together through a carbamate linkage, i.e.,

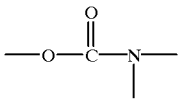

wherein the oxygen may be regarded as the terminal hydroxyl oxygen of the poly(oxyalkylene) alcohol, the nitrogen is derived from the polyamine and the carbonyl group —C(O)—, is preferably provided by a coupling agent, such as phosgene.

In a preferred method of preparation, the hydrocarbyl poly(oxyalkylene) alcohol is reacted with phosgene to produce a chloroformate and the chloroformate is reacted with the polyamine. Since there may be more than one nitrogen atom of the polyamine which is capable of reacting with the chloroformate, the carbamate product may contain more than one hydrocarbyl poly(oxyalkylene) moiety. It is preferred that the hydrocarbyl poly(oxyalkylene) aminocarbamate product contains on the average, about one poly(oxyalkylene) moiety per molecule (i.e., is a monocarbamate), although it is understood that this reaction route may lead to mixtures containing appreciable amounts of di- or higher poly(oxyalkylene) chain substitution on a polyamine containing several reactive nitrogen atoms.

A particularly preferred aminocarbamate is alkylphenyl poly(oxybutylene)aminocarbamate, wherein the amine moiety is derived from ethylene diamine or diethylene triamine. Synthetic methods to avoid higher degrees of substitution, methods of preparation, and other characteristics of the aminocarbamates used in the present invention are more fully described and exemplified in U.S. Pat. No. 4,191,537.

The Ester of a Carboxylic Acid and a Polyhydric Alcohol

As indicated above, the ester component employed in the present fuel composition is an ester of a carboxylic acid and a polyhydric alcohol, wherein the carboxylic acid has from one to about four carboxylic acid groups and from about 8 to about 50 carbon atoms and the polyhydric alcohol has from about 2 to about 50 carbon atoms and from about 2 to about 6 hydroxy groups.

The carboxylic acid employed in the preparation of the ester compound will generally be an aliphatic saturated or unsaturated, straight chain or branched chain, mono- or polycarboxylic acid having from about 1 to about 4 carboxylic acid groups and from about 8 to about 50 carbon atoms.

When the carboxylic acid is a monocarboxylic acid, it will preferably contain about 8 to about 30 carbon atoms, more preferably about 10 to about 28 carbon atoms, and most preferably about 10 to about 22 carbon atoms.

Examples of saturated monocarboxylic acids include those having about 10 to about 22 carbon atoms, such as capric, lauric, myristic, palmitic, stearic and behenic acid. Examples of unsaturated monocarboxylic acids include those having about 10 to about 22 carbon atoms, such as oleic, elaidic, palmitoleic, petroselic, eleostearic, linoleic, linolenic, erucic and hypogaeic acid.

When the carboxylic acid is a polycarboxylic acid, it generally will be an aliphatic saturated or unsaturated polycarboxylic acid having about 2 to about 4, preferably about 2 to about 3, and more preferably about 2 carboxylic acid groups. An example of a suitable dicarboxylic acid is dodecenyl succinic acid.

Preferably, the carboxylic acid is oleic acid.

The alcohol used in the preparation of the ester compound is generally an aliphatic, saturated or unsaturated, straight chain or branched chain polyhydric alcohol having from about 2 to about 6 hydroxy groups and from about 2 to about 50 carbon atoms, preferably, from about 2 to about 30 carbon atoms, and more preferably, from about 2 to about 12 carbon atoms.

Suitable polyhydric alcohols include dihydroxy alcohols, such as the alkylene glycols, for example, ethylene glycol and propylene glycol, trihydroxy alcohols, such as glycerol, tetrahydroxy alcohols, such as pentaerythritol, and hexahydroxy alcohols, such as sorbitol.

The carboxylic acid and polyhydric alcohol are reacted under typical esterification conditions well known in the art to provide the esters employed in the present invention.

Examples of esters of polyhydric alcohols that may be used are those where all of the hydroxy groups are esterified, as well as those where not all of the hydroxy groups are esterified. Specific examples are esters prepared from trihydric alcohols and one or more of the above-mentioned saturated or unsaturated carboxylic acids, such as glycerol monoesters and glycerol diesters, e.g. glycerol monooleate, glycerol dioleate and glycerol monostearate. Such polyhydric esters may be prepared by esterification as described in the art and/or may be commercially available.

The ester may have one or more free hydroxy groups.

Preferred esters which are suitable for use in the present invention include glycerol monooleate, pentaerythritol monooleate and sorbitan monooleate, particularly glycerol monooleate and pentaerythritol monooleate.

Fuel Compositions

The fuel additive composition utilized in the present invention will generally be employed in hydrocarbon fuels to reduce friction and reduce fuel consumption in internal combustion engines. The proper concentration of this additive composition necessary to achieve the desired reduction in fuel consumption varies depending upon the type of fuel employed, the type of engine, and the presence of other fuel additives.

Generally, the presently employed fuel additive composition will be employed in a hydrocarbon fuel boiling in the gasoline range in a concentration ranging from about 50 to about 5,000 parts per million (ppm) by weight, preferably from 100 to 2,500 ppm.

In terms of individual components, hydrocarbon fuel containing the fuel additive composition employed in this invention will generally contain about 25 to 2,000 ppm, preferably about 50 to 1,000 ppm, and more preferably about 50 to 500 ppm, of the amine component and about 25 to 2,000 ppm, preferably about 50 to 200 ppm, and more preferably about 75 to 200 ppm, of the ester component. The ratio of the ester compound to amine compound will generally range from about 0.01:1 to about 4:1, and will preferably be about 0.1:1 to about 2:1.

The fuel additive composition of the present invention may be formulated as a concentrate using an inert stable oleophilic (i.e., dissolves in gasoline) organic solvent boiling in the range of about 150° F. to 400° F. (about 65° C. to 205° C.). Preferably, an aliphatic or an aromatic hydrocarbon solvent is used, such as benzene, toluene, xylene or higher-boiling aromatics or aromatic thinners. Aliphatic alcohols containing about 3 to 8 carbon atoms, such as isopropanol, isobutylcarbinol, n-butanol and the like, in combination with hydrocarbon solvents are also suitable for use with the present additives. In the concentrate, the amount of the presently employed additive composition will generally range from about 10 to about 90 weight percent, preferably 10 to 80 weight percent, more preferably from 20 to 70 weight percent.

In gasoline fuels, other fuel additives may be employed with the additive composition used in the present invention, including, for example, oxygenates, such as t-butyl methyl ether, antiknock agents, such as methylcyclopentadienyl manganese tricarbonyl, lead scavengers such as aryl or alkyl halides, and detergent/dispersants. Additionally, antioxidants, metal deactivators, demulsifiers and carburetor or fuel injector detergents may be present.

A fuel-soluble, nonvolatile carrier fluid or oil may also be used with the fuel additive composition employed in this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic fluid, such as mineral oil, refined petroleum oils, synthetic polyalkanes and alkenes, including hydrogenated and unhydrogenated polyalphaolefins, and synthetic polyoxyalkylene-derived fluids, such as those described, for example, in U.S. Pat. No. 4,191,537 to Lewis, and polyesters, such as those described, for example, in U.S. Pat. No. 3,756,793 to Robinson and U.S. Pat. No. 5,004,478 to Vogel et al., and in European Patent Application Nos. 356,726, published Mar. 7, 1990, and 382,159, published Aug. 16, 1990.

These carrier fluids are believed to act as a carrier for the fuel additive composition employed in the present invention and to assist in removing and retarding deposits. The carrier fluid may also exhibit synergistic deposit control properties when used in combination with the fuel additive composition employed in this invention.

The carrier fluids are typically employed in amounts ranging from about 25 to about 5000 ppm by weight of the hydrocarbon fuel, preferably from 100 to 3000 ppm of the fuel. Preferably, the ratio of carrier fluid to additive will range from about 0.2:1 to about 10:1, more preferably from 0.4:1 to 4:1.

When employed in a fuel concentrate, carrier fluids will generally be present in amounts ranging from about 20 to about 60 weight percent, preferably from 30 to 50 weight percent.

The following examples are presented to illustrate specific embodiments of this invention and are not to be construed in any way as limiting the scope of the invention.

EXAMPLES

Example 1

Friction Coefficient Evaluation

The test compounds were evaluated in a mineral lubricating oil using a Pin-on-Disk tribometer to measure friction coefficients.

Evaluation of the additives was performed in a lubricant formulation and these results correlate well with expected frictional and fuel economy improvements when the additives are used in fuels employed in internal combustion engines. For example, this test may be used to predict the reduction in friction of the piston rings moving against the cylinder walls that have been lubricated by the combination of additives blended into the fuel and the fully formulated engine oil. The resulting reduction in friction observed may translate into an improvement in fuel economy. Additionally, these additives, when used in fuels, may actually help reduce wear of the internal combustion engine parts.

In this test procedure, all boundary friction coefficients were measured at 100° C. oil temperature using a Pin-on-Disk tribometer. The experimental conditions used included a pin diameter of 0.25 inches, a load of 500 gms, and sliding speeds ranging from 0.15 to 17.3 cm/s. Friction coefficients were compared at 2.9 cm/s. Both pin and disk were of ANSI 52100 steel.

The following test compounds were prepared or are available commercially:

Amine A: Dodecylphenyl poly(oxybutylene)diethylene triamine carbamate having an average molecular weight of about 1760, prepared as described in U.S. Pat. No. 4,160,648.

Amine B: Polyisobutenyl (1300 average molecular weight) ethylene diamine.

Carrier Oil: Dodecylphenyl poly(oxybutylene)mono-ol having an average molecular weight of about 1500.

Ester A: Glycerol monooleate.

Ester B: Pentaerythritol monooleate.

The additives used were blended in an API 10W/30 SH viscosity grade mineral oil as the base oil. The results of the Pin-on-Disk bench test are set forth in Table I.

TABLE I

| Test Sample | Additive Concentration, wgt. % | Friction Coefficient |
|---|---|---|
| Base Oil | — | 0.129 |
| Amine A | 4.44 | 0.12 |
| Amine B/Carrier Oil | 2.59/2.59 | 0.119 |
| Ester A | 2.96 | 0.1 |
| Amine A/Ester A | 4.44/2.96 | 0.088 |
| Amine B/Carrier Oil/Ester A | 2.59/2.59/2.96 | 0.091 |

The data in Table I demonstrates that the combination of amine and ester compounds has a synergistic effect and provides a greater reduction in boundary friction coefficient than either component individually. This result is particularly surprising, since both the amine and the ester are surface active compounds and therefore the combination should give rise to competition for the surface, thereby reducing the effectiveness of either compound.

Additional testing was carried out to measure boundary friction coefficients using a Pin-on-Disk tribometer at 100° C. oil temperature. The experimental conditions for this test included a pin diameter of 0.25 inches, a load of 4.9N, and sliding speeds ranging from 0.1 to 6,000 mm/min. Friction coefficients were compared at 100 mm/min. Both pin and disk were of ANSI 52100 steel.

The additives used were blended in an API 10W/30 SH viscosity grade mineral oil as the base oil. The results of this Pin-on-Disk bench test are set forth in Table II.

TABLE II

| Test Sample | Additive Concentration wgt. % | Friction Coefficient |
|---|---|---|
| Base Oil | — | 0.137 |
| Amine A | 4.44 | 0.129 |
| Amine B/Carrier Oil | 2.59/2.59 | 0.143 |
| Ester A | 2.96 | 0.114 |
| Amine A/EsterA | 4.44/2.96 | 0.114 |
| Amine B/Carrier Oil/Ester A | 2.59/2.59/2.96 | 0.105 |
| Ester B | 2.96 | 0.115 |
| Amine A/Ester B | 4.44/2.96 | 0.100 |
| Amine B/Carrier Oil/Ester B | 2.59/2.59/2.96 | 0.108 |

The data in Table II further demonstrates the significant reduction in boundary friction coefficients exhibited by the presently employed combination of amine and ester additives.

Example 2

Fuel Economy Evaluation

The test procedure for this evaluation was a modified version of the ASTM Sequence VI fuel economy test procedure. Fuel economy was measured using a carbureted 1982 Buick 3.8L V-6 engine.

Tests were run at both 150° F. and 275° F. oil temperatures. The engine oil used in the tests was an ASTM HR oil (SAE 20W/30 SE). All of the test runs were made with the same base gasoline, which was representative of commercial unleaded fuel. The base fuel employed in the engine tests contained no test additives. The test compounds as described in Example I were mixed with the base fuel at the concentrations indicated in Table II. The fuels were run in the engine over 40-hour time periods. The results are set forth in Table III, with positive numbers indicating an improvement in fuel economy.

TABLE III

| | Fuel Economy Improvement | | | | |
|---|---|---|---|---|---|
| Test Sample | Additive Conc., ppm | Percent Improvement, IL[1] | Percent Improvement, IH[2] | Percent Improvement, LTL[3] | Percent Improvement LTH[4] |
| Base Fuel (Run 1) | – | −0.2 | 0.2 | −0.3 | 2.2 |
| Base Fuel (Run 2) | – | 0.2 | 1.0 | 0.3 | 2.7 |
| Amine A | 300 | 0.0 | 1.7 | 0.1 | 2.8 |
| Amine A/Ester A | 300/50 | −1.0 | −0.1 | −0.8 | 1.9 |
| Amine A/Ester A | 300/75 | 0.3 | 1.1 | 0.1 | 3.5 |
| Amine A/Ester A | 300/125 | 0.2 | 3.6 | 0.5 | 4.9 |
| Amine A/Ester A | 300/125 | 0.1 | 1.2 | 0.1 | 4.0 |
| Amine A/Ester A | 300/200 | −0.5 | 2.1 | 0.4 | 4.1 |
| Amine A/Ester B | 300/50 | −0.2 | 0.3 | −0.1 | 2.3 |
| Amine A/Ester B | 300/125 | −0.1 | 1.7 | 0.3 | 4.0 |
| Amine A/Ester B | 300/200 | 0.1 | 1.6 | −0.2 | 2.6 |

[1]IL = Initial Low Temperature (150° F.)
[2]IH = Initial High Temperature (275° F.)
[3]LTL = Long Term Low Temperature
[4]LTH = Long Term High Temperature The data in Table III demonstrates the significant improvement in fuel economy exhibited by the presently employed combination of amine and ester additives, when compared to the base fuel with no additives.

What is claimed is:

1. A fuel composition comprising a major amount of hydrocarbons boiling in the gasoline range and a fuel consumption reducing amount of a fuel additive composition comprising:

(a) A polyisobutenyl amine having a number average molecular weight of about 700 to 3,000, wherein the amine moiety is derived from ammonia or a polyalkylene polyamine selected from the group consisting of ethylene diamine, diethylene triamine, triethylene tetramine and tetraethylene pentamine;

(b) An ester of a monocarboxylic acid having about 8 to about 30 carbon atoms and a polyhydric alcohol selected from the group consisting of alkylene glycol, glycerol, pentaerythritol and sorbitol; and (c) a fuel-soluble, nonvolatile carrier fluid.

2. A method of reducing fuel consumption in an internal combustion engine which comprises operating said engine with a fuel composition comprising a major amount of hydrocarbons boiling in the gasoline range and a fuel consumption reducing amount of a fuel additive composition comprising:

(a) A polyisobutenyl amine having a number average molecular weight of about 700 to 3,000, wherein the amine moiety is derived from ammonia or a polyalkylene polyamine selected from the group consisting of ethylene diamine, diethylene triamine, triethylene tetramine and tetraethylene pentamine;

(b) An ester of a monocarboxylic acid having about 8 to about 30 carbon atoms and a polyhydric alcohol selected from the group consisting of alkylene glycol, glycerol, pentaerythritol and sorbitol; and (d) a fuel-soluble, nonvolatile carrier fluid.

3. A fuel composition comprising a major amount of hydrocarbons boiling in the gasoline range and a fuel consumption reducing amount of a fuel additive composition comprising:

(a) an alkylphenyl poly(oxybutylene)aminocarbamate having about 5 to about 100 oxybutylene units, wherein the alkyl moiety of the alkylphenyl group is a straight or branched-chain alkyl having from 1 to about 24 carbon atoms and the amine moiety is derived from ethylene diamine or diethylene triamine; and (b) an ester of a monocarboxylic acid having about 8 to about 30 carbon atoms and a polyhydric alcohol selected from the group consisting of alkylene glycol, glycerol, pentaerytiritol and sorbitol.

4. The fuel composition according to claim 3, wherein said alkylphenyl poly(oxyalkylene)aminocarbamate has a molecular weight in the range of about 500 to about 10,000.

5. The fuel composition according to claim 3, wherein the alkyl moiety of said alkylphenyl group is tetrapropenyl.

6. The fuel composition according to claim 3, wherein the composition contains from about 25 to about 2,000 parts per million by weight of said alkylphenyl poly(oxybutylene) aminocarbomate and about 25 to about 2,000 parts per million of said ester.

7. The fuel composition according to claim 3, where the composition further contains from about 25 to about 5,000 parts per million by weight of a fuel-soluble, nonvolatile carrier fluid.

8. The fuel composition according to claim 3, wherein the monocarboxylic acid has about 10 to about 22 carbon atoms.

9. The fuel composition according to claim 8, wherein the monocarboxylic acid is oleic acid.

10. The fuel composition according to claim 3 wherein the ester of component (b) is glycerol monooleate or pentaerythritol monooleate.

11. A method for reducing fuel consumption in an internal combustion engine which comprises operating said engine with a fuel composition comprising a major amount of hydrocarbons boiling in the gasoline range and a fuel consumption reducing amount of a fuel additive composition comprising:

(a) an alkylphenyl poly(oxybutylene)aminocarbamate having about 5 to about 100 oxybutylene units, wherein the alkyl moiety of the alkylphenyl group is a straight or branched-chain alkyl having from 1 to about 24 carbon atoms and the amine moiety is derived from ethylene diamine or diethylene triamine; and (b) an ester of a monocarboxylic acid having about 8 to about 30 carbon atoms and a polyhydric alcohol selected from the group consisting of alkylene glycol, glycerol, pentaerythritol and sorbitol.

12. The method according to claim 11, wherein said alkylphenyl poly(oxyalkylene)aminocarbamate has a molecular weight in the range of about 500 to about 10,000.

13. The method according to claim 11, wherein the alkyl moiety of said alkylphenyl group is tetrapropenyl.

14. The method according to claim 11, wherein the composition contains from about 25 to about 2,000 parts per million by weight of said alkylphenyl poly(oxybutylene) aminocarbamate compound and about 25 to about 2,000 parts per million of said ester.

15. The method according to claim 11, where the composition further contains from about 25 to about 5,000 parts per million by weight of a fuel-soluble, nonvolatile carrier fluid.

16. The method according to claim 11, wherein the monocarboxylic acid has about 10 to about 22 carbon atoms.

17. The method according to claim 16, wherein the monocarboxylic acid is oleic acid.

18. The method according to claim 11 wherein the ester of component (b) is glycerol monooleate or pentaerythritol monooleate.

* * * * *